United States Patent [19]

Romanowski et al.

[11] Patent Number: 4,811,781

[45] Date of Patent: Mar. 14, 1989

[54] FEED TIP AND CONTINUOUS CASTING METHOD USING THE FEED TIP

[75] Inventors: Christopher A. Romanowski, Lake Arrowhead; Herman Landero, Colton, both of Calif.

[73] Assignee: Hunter Engineering Company, Inc., Riverside, Calif.

[21] Appl. No.: 169,870

[22] Filed: Mar. 17, 1988

[51] Int. Cl.[4] ..... B22D 11/06; B22D 11/10

[52] U.S. Cl. ..... 164/480; 164/428; 164/437; 164/488; 222/591

[58] Field of Search ..... 164/428, 437, 480, 488; 222/590, 591

[56] References Cited

U.S. PATENT DOCUMENTS 4,232,804 11/1980 Lewis et al. ..... 222/591
4,303,181 12/1981 Lewis et al. ..... 222/591
4,619,309 10/1986 Huber et al. ..... 164/437 X
4,650,775 3/1987 Hill ..... 501/95
4,716,956 1/1988 Hoffman et al. ..... 164/480

*Primary Examiner*—Nicholas P. Godici
*Assistant Examiner*—J. Reed Batten, Jr.
*Attorney, Agent, or Firm*—Christie, Parker & Hale

[57] ABSTRACT

The feed tip is provided by a pair of spaced apart refractory bodies defining a feed path for the molten metal. Each refractory body has an upstream portion and a downstream edge and the bodies taper, in cross-section, in a direction towards the downstream edge. A discharge gap for the molten metal is defined by the downstream edges of the refractory bodies. The refractory bodies are made from a recently developed material which is a blend of aluminosilicate fibers, silicon powder and a boron constituent, preferably boron nitride.

7 Claims, 1 Drawing Sheet

FEED TIP AND CONTINUOUS CASTING METHOD USING THE FEED TIP

FIELD OF THE INVENTION

This invention relates to a feed tip suitable for use in the casting of molten metal and to an improved method of casting aluminum using the feed tips. More particularly, but not exclusively, the invention concerns feed tips of the kind shown in U.S. Pat. Nos. 4,232,804 and 4,303,181. These patents are incorporated herein by reference.

BACKGROUND OF THE INVENTION

There has recently been increased concern regarding asbestos-containing products. These are considered to be potentially carcinogenic. This has led increasingly to product substitution and a marked increase in safety measures where people may be exposed to asbestos. Asbestos in fine particulate form is thought to be especially dangerous as it may become airborne and be inhaled. Concern about the potential carcinogenicity of asbestos has resulted in decreased popularity of asbestos-containing products in refractory and thermal insulation materials. Feed tips of the present invention are refractory materials without asbestos.

Reasonably satisfactory molten metal feed tips have been made from an insulating composition that is a composite of asbestos fibers and clay particles. Such a material is available from the Johns Manville Company under their trademark Marinite. This material is obtained in flat slabs or planks which are cut and machined to the desired configuration for molten metal feed tips, as well as various launders and other parts of the molten metal handling system.

Although such material is readily formed and resists molten aluminum and the like it has significant shortcomings. One of the more significant problems with such material is the presence of asbestos.

Other insulating materials have been substituted for asbestos in refractory materials. One such effort is represented by U.S. Pat. Nos. 4,232,804 and 4,303,181.

In U.S. Pat. No. 4,232,804 a molten metal feed tip for a continuous caster comprises a pair of generally rectangular refractory members spaced apart for forming a metal feeding gap between the members. Each of these members has a downstream edge and an upstream portion having a greater thickness than the downstream edge and each is formed of a layer of refractory fibers such as an alumina-silica composition, rigidly bonded together by a refractory binder containing colloidal silica. The members can be laminated to provide nonhomogeneous properties between the inside and outside faces. A glass fabric may be bonded to the inside faces of the members forming the feed tip.

A tip as described in U.S. Pat. No. 4,232,804 has appreciable advantages over that previously formed of an asbestos and clay composition. Prominent of course is the elimination of a health hazard. In addition, however, the feed tip is roughly twice as strong as that previously used and is essentially unchanged by contact with moisture. Tips made of refractory fiber felt bonded with colloidal silica can be reused in the continuous caster whereas the prior tips containing asbestos could rarely, if ever, be reused.

In U.S. Pat. No. 4,303,181, a feed tip as described in U.S. Pat. No. 4,232,804 is formed of a felt of refractory fibers rigidly bonded together by a refractory binder.

The downstream edges of the members providing the feed tip are compressed to a higher density and strength than the upstream portion, and have a higher thermal conductivity than the upstream portion.

Similarly, the feed tip described in U.S. Pat. No. 4,303,181 is roughly twice as strong as that previously used and is substantially unchanged by contact with moisture.

A new refractory material which we have found suitable for forming feed tips for the casting of molten metal has recently been marketed.

BRIEF SUMMARY OF THE INVENTION

There is, therefore, provided in the practice of the present invention the new use of a recently developed refractory material to form feed tips for use in the casting of molten metal.

In one aspect, this invention relates to a feed tip suitable for use in a continuous casting process for molten metal, which feed tip comprises a pair of spaced rigid bodies defining a feed path for the molten metal and a discharge gap along a downstream edge from which the molten metal is cast, which bodies taper in cross-section in a direction towards the discharge gap, the bodies being formed from a refractory material which comprises a sintered blend of aluminosilicate fibers, silica powder and a boron constituent, preferably boron nitride.

In another aspect, the present invention concerns a process for the continuous casting of molten metal using a feed tip made from such a new refractory material.

The refractory material comprises aluminosilicate fibers, silica powder, rather than silica fiber, and a compound of boron, preferably boron nitride powder.

The constituents may be in the range, by weight, of between 70 to 90% aluminosilicate fiber, 7 to 25% silica powder and 2.5 to 8% boron nitride.

The constituents are preferably mixed to form a blend which is then furnace dried and fired at a temperature sufficiently high to flux the boron and silica powder and join or fuse the fiber intersections upon cooling to form a rigid refractory body. The sintering temperature is preferably above 2200° F. and is ideally between 2350° and 2500° F.

In one form of the product, a blend of 75% aluminosilicate fiber, 20% silica powder (−325 mesh) and 5% boron nitride powder (−325 mesh) is sintered by firing at a temperature of at least 2350° F. (1288° C.).

In another form of the product, the blend comprises 76.2% aluminosilicate fiber, 19% silica powder and 4.8% boron nitride.

In yet another form, the blend comprises 89.5% aluminosilicate fiber, 7.2% silica powder and 3.3% boron nitride powder. In this form, the silica powder may comprise amorphous fumed silica.

Higher fiber and lower binder content is preferred to form a material with lower thermal conductivity.

The use of silica powder as a bond former, rather than silica fibers, is unusual though not unique in that conventional thermal bonding theory generally teaches the use of silica fiber as a bonding agent.

BRIEF DESCRIPTION OF THE DRAWINGS

These and other features and advantages of the present invention will be appreciated as the same becomes better understood by reference to the following detailed description when considered in connection with the accompanying drawings, example and tables. In the drawings.

DETAILED DESCRIPTION OF THE PREFERRED EMBODIMENT

Figure 1:
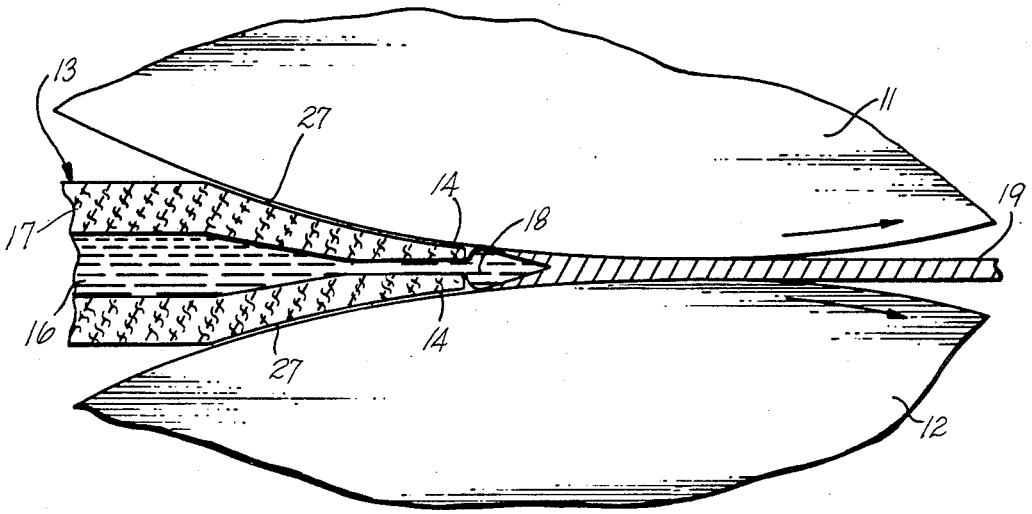
FIG. 1 illustrates in cross section a molten metal feed tip for a continuous caster.

FIG. 1 illustrates in transverse cross section a pair of rolls 11 and 12 of a continuous casting machine. The axes of the two rolls are parallel and they are driven in the direction of movement of metal through the continuous caster (to the right in FIG. 1). A molten metal feed tip 13 has a pair of downstream edges 14 inserted into the narrow gap between the upper and lower rolls. Molten metal 16 is introduced through an upstream portion 17 of the feed tip and flows toward the downstream edges 14. The molten metal emerges from the feed tip and increases in cross section to engage the surface of the rolls. Heat from the molten metal is extracted by the water cooled rolls and freezing occurs in a narrow zone 18 between the rolls and outside the feed tip. The metal sheet so formed continues through the gap between the slowly rotating rolls and is reduced in thickness to introduce hot working in the metal for refining grain structure. A sheet 19 of solid metal leaves the rolls on the opposite side from the molten metal feed tip.

Although for convenience of illustration the feed tip 13 is shown in a generally horizontal plane with the upper roll 11 directly above the lower roll 12, it will be apparent that the same arrangement is applicable to other orientations. Thus, there are certain advantages in a vertical continuous caster where the axes of the rolls are in a horizontal plane and molten metal is fed upwardly into the gap between the rolls. There are also distinct advantages to an arrangement where the plane of the feed tip is tilted upwardly at about 15° from horizontal so that molten metal feeds upwardly into the gap between the rolls. The molten metal feed tip provided in the practice of this invention is suitable for use in any such orientation.

The downstream edges 14 of the feed tip are spaced apart to provide a continuous gap extending along the length of the rolls with the gap having a total length corresponding approximately to the desired width of the shet being cast. Conventional flaring end dams (not shown) close the ends of the feed tip and help define the width of the sheet being cast. The width of the sheet prepared in a manufacturing operation can differ from time to time and the maximum is dependent on the length of the rolls. A width of 1.5 to 2 meters is common. The molten metal feed tip is therefore made in a plurality of segments with each segment typically extending 20 centimeters or more along the length of the rolls. Thus, a greater or lesser number of segments can be assembled to form a molten metal feed tip of a desired width for the continuous caster. If desired, the feed tip can be made in lengths corresponding to the width of the rolls instead of being assembled of shorter segments.

Figure 2:
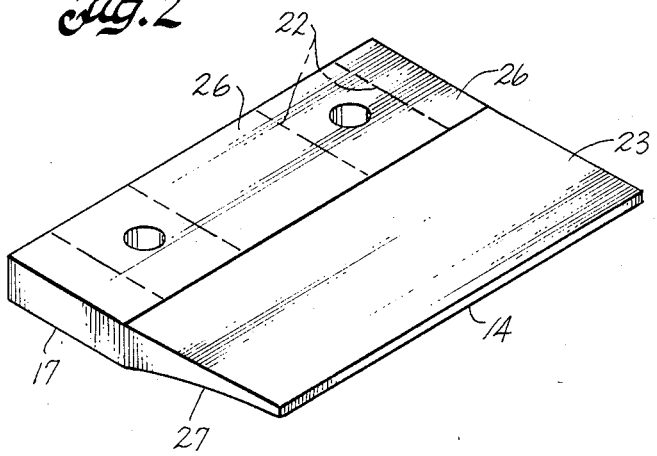
FIG. 2 illustrates in perspective one moiety of such a tip.

One moiety of such a segment is illustrated in perspective in FIG. 2. Each segment of the continuous caster is formed of a pair of similar moieties which are generally rectangular. Spacers (not shown) are provided between the upstream portions 17 of the two moieties to space them apart and form the metal feeding gap between the inside faces 23 of each half of the feed tip segment. The locations of suitable spacers are indicated in FIG. 2 by the phantom lines 22. The parts of a segment of a molten metal feed tip can be connected together by bolts or the like extending through holes 24 through the two moieties and spacers.

If desired, instead of the rectangular spacers suggested by the phantom lines 22 in FIG. 2, a streamlined spacer or spacers can be used between the two moieties of the feed tip to further minimize disruptions in the velocity of molten metal flow through the feed tip.

Generally the spacers between the upstream portions of the two halves of the feed tip are sufficient for maintaining a desired gap between the downstream edges 14 of the feed tip. If desired, an additional spacer or spacers can be provided at an intermediate location between the upstream portion 17 and the downstream edges 14. Such a spacer, if used, should be reasonably streamlined to avoid disturbance in the metal flow through the feed tip.

The spaces 26 between the spacers provide means for admitting liquid metal to the gap between the two halves of the feed tip. The cross-sectional area for metal flow through the spaces 26 at the upstream portion of the feed tip is preferably greater than the cross-section area for metal flow through the gap between the downstream edges 14 of the tip. This assures that metal velocity increases as it flows through the tip instead of decelerating. A substantially straight taper of the gap through which molten metal 16 flows between the upstream portion and the downstream edges is also desirable to minimize abrupt changes in the velocity of metal flowing through the continuous caster tip. Such an arrangement can minimize discontinuities in metal flow and avoid introduction of impurities in sheet formed by the continuous caster. The generally planar inner face also allows the members to be thicker in regions near the downstream edges and enhances strength. This aspect permits the outside face of each moiety to have a generally planar portion adjacent the downstream edge.

The outside faces 27 of the two halves of the feed tip are preferably parallel in the upstream portion for ease of interconnection of the parts to form a segment of the feed tip. Each half of the feed tip has a concavely curved portion on the outside face between the downstream edge 14 and the upstream portion, diverging from the central plane of the feed tip towards the upstream portion. The curvature corresponds to the radius of the largest diameter rolls used so that a single tip size can fit into the narrow gap between the feed tip and the rolls for various sizes of rolling mills. The narrow space between the tip and the roll permits escape of water and other vapors from the vicinity of the molten metal. Rapid removal of water vapor can prolong the useful lifetime of the feed tip. The taper of the feed tip provides a robust tip that can fit quite near the nip of the rolls and provides a continuous progressive change in physical properties of the caster tip. That is, there are no sudden changes in physical or mechanical properties of the feed tip.

In the practice of this invention, a feed tip as described is formed from a material including a blend of aluminosilicate fibers, silica powder and boron nitride, which material forms the subject matter of U.S. Pat. No. 4,650,775, by Charles A. Hill and assigned to The Babcock and Wilcox Company, the subject matter of which is hereby incorporated by reference.

The constituents may be in the range, by weight, of between 70 to 90% aluminosilicate fiber, 7 to 25% silica powder and 2.5 to 8% boron nitride.

The constituents are preferably mixed to form a blend which is then furnace dried and fired at a temperature sufficiently high to flux the boron and silica powder and join or fuse the fiber intersections upon cooling to form a rigid refractory body. Upon cooling, a very strong, lightweight refractory material results. The material is suggested in the Hill patent to be particularly suited for use as diesel soot filters, kiln furniture, combustor liners and burner tubes. The sintering temperature is preferably above 2200° F. and is ideally between 2350° and 2500° F.

In another form of the product, the blend comprises 76.2% aluminosilicate fiber, 19% silica powder and 4.8% boron nitride.

In yet another form, the blend comprises 89.5% aluminosilicate fiber, 7.2% silica powder and 3.3% boron nitride powder. In this form, the silica powder may comprise amorphous fumed silica.

Higher fiber and lower binder content is preferred to form a material with lower thermal conductivity. Higher binder content is preferred for forming a material with greater strength. A cube or slab of the material may be machined and shaped with a grinding wheel to form the feed tip.

A suitable grinding wheel is of the kind comprised of white aluminum oxide of medium grit size and which has vitrified bonds. A grinding wheel of this kind is manufactured by Bay State Abrasives.

The invention will further be illustrated with reference to the following example and tables.

EXAMPLE

A 12 inch square slab of a product obtained from The Babcock and Wilcox Company and marketed by that company as a standard soot filter material, referenced Mix 194-Z, was shaped with a grinding wheel of the kind described above to form a feed tip. The approximate composition was 36% $Al_2O_3$, 59% $SiO_2$ and 5% BN. The feed tip may be shaped to have a lip thickness in the range between 0.065 in. to 0.105 in. In this example, the tip moiety was shaped to leave a lip thickness of 0.085 in. at the discharge gap.

The material was found to have initial properties as shown in Table I below:

TABLE I

| Property | Strong Direction | Weak Direction |
|---|---|---|
| Density (pcf) | 34 | 34 |
| MOR (psi) | 1500 | 300 |
| Compressive strength (psi) | 3800 | 900 |

After reheating for 24 hours at various temperatures, the material was found to have the properties reflected in Table II below:

TABLE II

| Temp. (°F.) | Density (pcf) | MOR (psi) | Length Change (%) | Shrinkage Thickness (%) | Volume Change (%) |
|---|---|---|---|---|---|
| 2100 | 36.4 | 1425 | 0.0 | 0.2 | 0.2 |
| 2400 | 42.2 | 1580 | 1.6 | 10.0 | 13.4 |
| 2600 | 52.0 | 1444 | 4.9 | 22.0 | 29.8 |

The ASTM C201 thermal conductivity of the material fired at 2400° F. and density of 30.9 pcf, at a range of temperatures is reflected in Table III below, the units of conductivity being BTU·inch/hour·ft$^2$·°F.:

TABLE III

| Mean Temp. (°F.) | Thermal Conductivity |
|---|---|
| 200 | 0.45 |
| 400 | 0.50 |
| 600 | 0.57 |
| 800 | 0.64 |
| 1000 | 0.71 |
| 1200 | 0.78 |
| 1400 | 0.86 |
| 1600 | 0.93 |
| 1800 | 1.01 |

This material has surprisingly been found to be superior to previously known asbestos-free refractory materials used to form feed tips for molten metal casting. It has very low thermal conductivity. As a result of its thermally stable character, the feed tips can be used more than once. Previously known and used materials are subject to significant alteration upon heating and cooling, resulting in deterioration of the tip. The material used in the present invention does not change dimensions significantly upon heating and subsequent cooling. This thermal stability is evident from the above Tables.

Moreover, the material used in the invention is virtually immune to deterioration when casting metals such as aluminum and magnesium in the molten state. This is another characteristic of the material which results from its thermal stability. Known materials, being thermally less stable, often deteriorate when casting molten metals such as aluminum and especially magnesium.

Another surprisingly advantageous attribute of the present material is water stability. High levels of atmospheric water vapor exist around casting mills as a result of the water used to deposit a graphite coating on the rolls. As the casting rolls cool as they move away from the casting zone, vapor tends to condense on the rolls near the location molten metal enters to the roll nip and drip onto the feed tip moieties. Water also combines with aluminum oxide on the roll surfaces and forms a hydroxide. This reaction reverses when the molten metal contacts the rolls, emitting substantial amounts of water vapor right at the edges of the feed tip. Previously used materials were subject to erosion and, therefore, deterioration by such water. The present material is water stable and accordingly has a longer useful life than previous materials. Water stability is a property which is not of significance in other suggested applications of high temperature ceramic insulating materials and is not generally known for such materials. Thus, it is not readily apparent which of a broad variety of materials may prove to be suitable for metal casting tips for a roll caster.

A further advantageous attribute is the workability of the material. It is of sufficiently rigid character that it may be machined by grinding and sawing without crumbling. It is also of a character which will hold a nail driven into it or a screw threaded into it. The material is accordingly eminently suitable for forming a feed tip of the present invention.

Although the invention has been described and illustrated with reference to presently preferred embodiments, it will be apparent to those skilled in the art that many variations and modifications are possible without departing from the scope of the appended claims.

What is claimed is:

1. A feed tip suitable for use in the continuous casting of molten metal comprising:

a pair of spaced rigid refractory bodies defining a feed path for molten metal, each refractory body having an upstream portion and a downstream edge, and which bodies taper, in cross-section, in a direction towards the downstream edge to define a discharge gap for the tip;

said feed tip being formed from a material comprising a blend of aluminosilicate fibers, silica powder and a boron constituent heated to a sufficiently high temperature to form a rigid body.

2. The feed tip of claim 1 in which the boron constituent comprises boron nitride.

3. The feed tip of claim 1 in which the thickness of a lip along the downstream edge of the feed tip is in the range between 0.065 in to 0.105 in.

4. The feed tip of claim 3 in which the lip is 0.085 in. thick.

5. A process for the continuous casting of molten metal comprising:

feeding molten metal along a feed path defined between a pair of spaced apart refractory members to cast the metal from a discharge gap defined by downstream edges of the refractory members, said refractory members being made from a material which is a blend of aluminosilicate fibers, silica powder and a compound of boron heated to a sufficiently high temperature to form a rigid body.

6. The process of claim 5 in which the molten metal comprises aluminum.

7. The process of claim 5 in which the compound of boron is boron nitride.

* * * * *